US005131102A

United States Patent [19]

Salley et al.

[11] Patent Number: 5,131,102

[45] Date of Patent: Jul. 21, 1992

[54] SPA COVER LIFT ASSEMBLY

[75] Inventors: Philip J. Salley, La Jolla; Edwin C. Sorensen, II, Vista, both of Calif.; Roger J. Quellette, Phoenix, Ariz.

[73] Assignee: SPA Centers, Inc, Oceanside, Calif.

[21] Appl. No.: 716,585

[22] Filed: Jun. 17, 1991

[51] Int. Cl.[5] ..... E04H 4/00

[52] U.S. Cl. ..... 4/498; 4/494; 4/503; 160/229.1; 180/69.2; 296/100; 220/329

[58] Field of Search ..... 4/498, 503, 494; 180/69.21, 69.2; 296/100; 220/263, 329, 330, 331; 49/127, 196; 160/229.1, 181, 210

[56] References Cited

U.S. PATENT DOCUMENTS

| | | | |
|---|---|---|---|
| 1,106,228 | 8/1914 | Adams | 220/263 |
| 2,912,703 | 11/1959 | Murphy | 4/494 |
| 3,002,195 | 10/1961 | Prudek | 4/494 |
| 3,051,964 | 9/1962 | Fisher et al. | 4/494 |
| 3,094,710 | 6/1963 | Hoke | 4/494 |
| 3,209,373 | 5/1965 | Meredith et al. | 4/494 |
| 3,490,642 | 1/1970 | Friedlander | 220/331 |
| 3,854,149 | 12/1974 | Mischke | 4/494 |
| 3,889,843 | 6/1975 | Miller | 220/331 |
| 4,083,596 | 4/1978 | Robertson | 296/100 |
| 4,135,159 | 1/1979 | Scardenzan | 4/498 |
| 4,422,192 | 12/1983 | Jacobs | 4/498 |
| 4,593,873 | 10/1986 | Nelson | 220/263 |
| 4,691,957 | 9/1987 | Ellingson | 296/100 |
| 4,821,902 | 4/1989 | May | 220/331 |
| 4,853,985 | 8/1989 | Perry | 4/498 |
| 4,964,669 | 10/1990 | Geier | 296/100 |
| 5,048,153 | 9/1991 | Wall et al. | 16/223 |

FOREIGN PATENT DOCUMENTS

| | | | |
|---|---|---|---|
| 1167738 | 4/1964 | Fed. Rep. of Germany | 220/331 |
| 3416889 | 11/1985 | Fed. Rep. of Germany | 4/498 |

*Primary Examiner*—Henry J. Recla
*Assistant Examiner*—Keith Kupferschmid
*Attorney, Agent, or Firm*—Harness, Dickey & Pierce

[57] ABSTRACT

A device for use in conjunction with a spa cover or spa cover mounted for pivotal movement to facilitate the removal of the cover away from the vicinity of the spa or spa when same is in use. In one embodiment, a bridge arm supported by two side arms is pivotally attached to a base. The bridge arm can be pivoted into position adjacent the spa cover. The spa cover folded over the bridge arm, and the bridge arm, along with the supported cover, is pivoted clearly away from the spa or spa area. In an alternate embodiment, a step elbow is provided near the point of pivotal attachment to the spa or spa to facilitate a step assisted pivoting and to provide a pivotal stop.

15 Claims, 3 Drawing Sheets

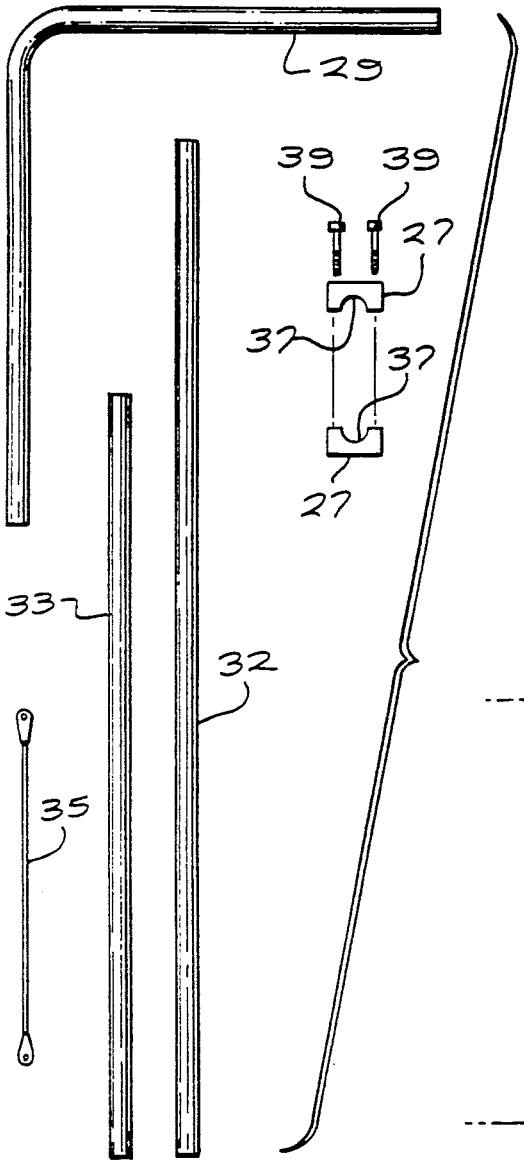
FIG. 5
FIG. 6
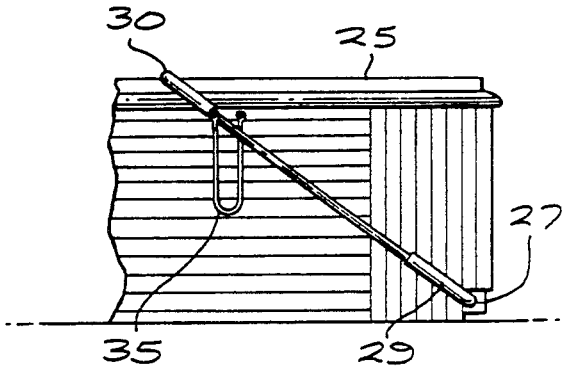
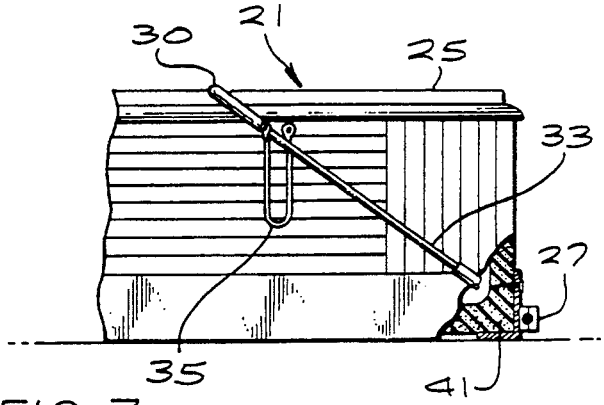
FIG. 7
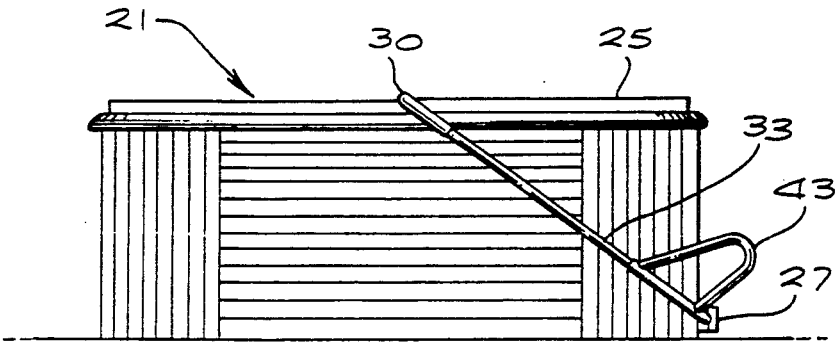
FIG. 8

SPA COVER LIFT ASSEMBLY

BACKGROUND OF THE INVENTION

The present invention relates generally to a support structure for a hot tub, pool, or spa having a cover.

Pools, hot tubs and spas, hereinafter referred to as "spas," are increasingly used in homes, recreation centers and hotels. When the spas are left exposed to the surroundings, the loss of heat energy and increased maintenance for the removal of debris falling into the spa makes the utilization of a cover desirable. Spa covers utilizable to provide adequate cover are manufactured in a range of sizes and materials of construction.

The problem with all covers, however, is their bulky size and/or weight which makes it difficult to cover and uncover the spa. Removal and replacement of the covers by those who are physically disadvantaged such as individuals who are physically of less than average strength poses a substantial problem.

Some spas have been designed with a specific mechanism particularly operable with a specific type of cover. Such "customized" and specific configurations work well when the spa is purchased with the particular cover and cover lift mechanism, but do not afford the universal applicability necessary for use with existing spas.

What is needed is a system which could be used with a wide variety of existing spa cover and which would enable and facilitate the use of those covers with less effort.

SUMMARY OF THE INVENTION

The present invention discloses a support mechanism for removing and replacing spa covers, and storing or holding them in a safe position. The method and apparatus of the present invention involves less strength to remove and replace the spa cover. The utilization of the inventive mechanism does not involve the denigration of the cover integrity. A bridge arm is brought down to a place adjacent the spa cover. The spa cover is folded over the bridge arm, and the bridge arm is then pivoted away from the spa, thus removing the spa cover.

BRIEF DESCRIPTION OF THE DRAWINGS

FIG. 5 illustrates the component parts of the cover lift assembly of FIGS. 1–4 in kit form;

FIG. 6 illustrates the mounting of the cover lift assembly against a pedestal skirt of the spa illustrated in FIGS. 1–3;

FIG. 7 illustrates the mounting of the cover lift assembly against a flush skirt utilized on the spa illustrated in FIGS. 1–3;

FIG. 8 illustrates a further embodiment of the cover lift assembly with an optional kick stand for facilitating the cover lift and restricting the degree of pivot of the cover lift;

DETAILED DESCRIPTION OF THE PREFERRED EMBODIMENTS

The spa cover support assembly and method of the present invention can be utilized for a variety of different types of spas. Often the shape of the spa may vary, as for example, round, square, hexagonal or polygonal. The spa may be above ground or at ground level. The spa covers with which the support assembly and method of the present invention are utilizable may vary, but the present invention works well with two-piece foldable covers.

Figure 1:
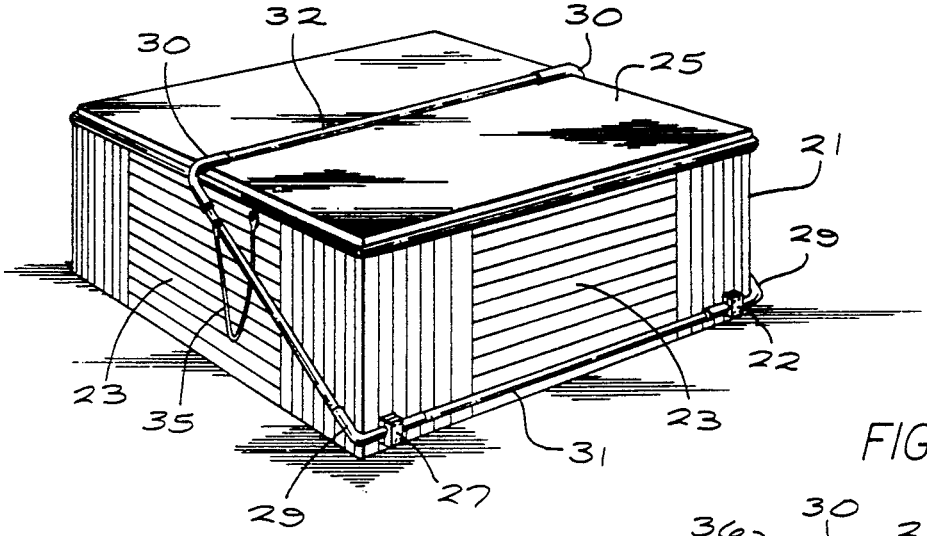
FIG. 1 is a perspective view of a spa fitted with the cover lift assembly of the present invention.

Referring to FIG. 1, a spa 21 employing the cover lift assembly is illustrated. The perspective view is of an above ground, somewhat rectangularly shaped spa 21, with the cover lift assembly of the present invention attached, shown from the side of attachment of the cover lift assembly. Spa 21 has a series of side walls 23 which define the overall shape of spa 21. A cover 25 has a shape sufficient to cover the upper edge of side walls 23 about the perimeter of spa 21.

A pair of pivot blocks 27 are attached to one of the side walls 23 of spa 21, and each rotatably support one portion of a pair of lower corner bars 29. As can been seen in FIG. 1, the lower corner bars 29 with a pair of upper corner bars 30 form the corners of a rectangularly shaped pivoting structure, hereinafter referred to as the pivoting structure. A lower bridge arm 31 and upper bridge arm 32 span the greater portion of the width of the spa 21 at the upper side across the cover 25 and at the lower side between the pivot blocks 27. Lower bridge arm 31 is optional and utilized for greater stability. It is understood that a single pivot block could be used to engage the center of the lower bridge arm, especially an extended length pivot block 27. In FIG. 1, a pair of pivoting supports 33 complete the rectangle, extending at an angle between the upper set of corner bars 30 and lower set of corner bars 29. As can be seen four corner bars 29 and 30 are used for the four corners of the rectangularly shaped pivoting structure.

The upper bridge arm 32 may be pivoted up and away from the upper surface of the cover 25. Typically the cover 25 will be of the two-piece foldable type, usually foldable about a hinged or other joint extending across its width (the hinge not visible in FIG. 1). Cover 25 will also be somewhat rigid, its surfaces having at least some structural integrity. In FIG. 1, the axis of fold is not readily seen, since it extends across and just underneath the upper bridge arm 32 as it rests upon cover 25. The axis of upper bridge arm 32 is parallel with the axis of the fold formable in cover 25. Such axis alignment allows one half of the cover 25 to be folded over upper bridge arm 32.

Cover 25 may or may not have an extended or flexible hinge to accommodate the diameter of upper bridge arm 32. If the hinged connection of the halves of cover 25 forms a sharp angle, the upper bridge arm 32 may be made to fall somewhat short of a position directly over the hinge axis, but still parallel with it. In such case, one half of the cover 25 will be foldable over the other half of the cover 25 but will not come to a rest against the other half, and will remain at an acute angle with respect to the other half. The adjustment of the point of contact of upper bridge arm 32 with respect to the fold axis of cover 25 should be performed during installation to maximize the effectiveness and compatibility with the particular cover 25 utilized. Alternately, the upper bridge arm 32 may be made of oval or flattened material to accommodate a sharply folding cover 25.

A retaining chain 35 is also illustrated in operational position. Ideally, two retaining chains 35 are utilized, each in attachment with one of the two pivoting supports 33 located on either side of the spa 21. In this manner, the angular displacement of the pivoting supports will be equally restricted in their angular displacement away from spa 21.

Figure 2:
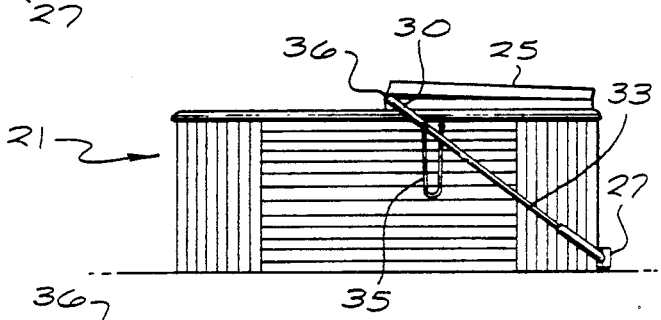
FIG. 2 illustrates the initial operation of the cover lift assembly on the spa illustrated in FIG. 1.
Figure 3:
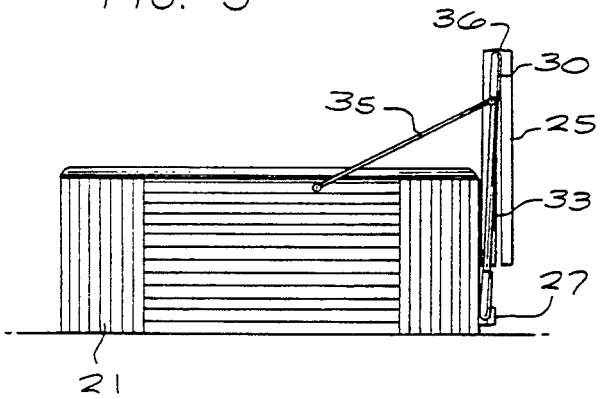
FIG. 3 illustrates the operation of the cover lift assembly on the spa illustrated in FIG. 1 to final uncovered position.

FIGS. 1–3 illustrate the method of operation of the cover lift assembly of the present invention. In FIG. 1, the rectangularly shaped pivoting structure, which is comprised of upper and lower bridge arms 32 and 31, a pair of side pivoting supports 33, and four joining upper and lower corner bars 29 and 30, is pivotally supported by a pair of pivot blocks 27. The upper bridge arm 32 is pivoted into contact or proximity with the folding axis of the cover 25.

One side of the cover 25 is folded over about a hinge 36, effectively trapping the bridge arm 32 at a point near the axis of the fold, as is shown by the side view in FIG. 2. The spa 21 is now half open, and the pivoting support 33 is ready for pivoting actuation. The user of this embodiment simply lifts the nearest pivoting support 33 upwardly and away from the spa 21 to both lift and slide the cover 25 from the spa 21.

As is shown in FIG. 3, the cover 25 is lifted up, away and behind or to the side of spa 21. Note the slight angled deviation from the vertical position which the pivoting support 33 assumes. The slight angle away from spa 21 insures that the pivoting structure with the folded cover 25 will remain in a stable position bearing somewhat away from the center of spa 21. The retaining chain 35 is utilized to prevent the further motion of pivoting supports 33 away from the body of the spa 21.

Alternately, when the spa 21 is located near a suitable stable structure such as a pole; wall or other structure, the pivoting supports 33 and the cover 25 it supports may be simply leaned against such adjacent pole, wall or other suitable support.

To replace the cover, the steps are simply reversed. The user approaches the pivoting support 33 grasping it about the upper portion of its length, and pulls the pivoting support 33 toward the spa 21. The cover is brought to level as it is pulled across the edge of spa 21. Since the dimensioning of the support system of the present invention is set during installation, the cover 25 will be replaced on the spa 21 in the same position from which it was removed. Once the cover 25 is brought level with the top of the spa 21, the upper half of the cover is simply folded over to unfold the cover 25 and complete the covering of the spa 21. At this point, the user may leave the pivoting support 33 in place or may swing it back to its vertical position for out-of-the-way storage.

In addition, the support assembly of the present invention is especially amenable to reduction to kit form. Referring to FIG. 5, the structural members assembleable to form a first embodiment illustrated in FIGS. 1–4, are illustrated. The pivoting support 33 is made of tubing which may have a nominal outer diameter of about one inch. The tubing will preferably be made of aluminum or other comparable lightweight material having acceptable structural characteristics.

A corner bar 29, which is equivalent to corner bar 30, is a length of tubing having a ninety degree turn. Typically the corner will be formed at a radius of from two to three inches to insure that structural integrity is maintained. The inner diameter of the corner bar 29 will ideally be greater than the outer diameter of the pivoting support 33, such that the pivoting support 33 may fit within corner bar 29. Alternatively, the corner bar may have an outside diameter to fit inside the pivoting support 33.

The bridge arm 32 or 31 may have the same diameter as the pivoting support 33 to cooperatively fit either inside or outside of corner bar 29 or 30 in the same fashion as pivoting support 33. Typically, the bridge arms 31 and 32 will have a length somewhat equivalent or greater than the diameter of the spa over which the support assembly of the present invention is to be utilized.

A pivot block 27 is typically a two piece or one piece structure having a bore 37, when assembled, extending completely therethrough. The diameter of bore 37 will be greater than the outside diameter of corner bar 29 in order that one portion of corner bar 29 may extend through and be rotatably supported by pivot block 27. A pair of bolts 39 are used to secure the halves of pivot block 27. A retaining chain or cable 35, provided to limit the movement of the support assembly of the present invention, may be made of steel wire or chain, and is shown here as having a pair of connecting eyelets, one at each end.

Alternate methods of attachment of pivot block 27 to a spa 21 are illustrated in FIGS. 6 and 7. In FIGS. 1–3, what is known as a flush skirt attachment method was illustrated. There, the pivot block 27 was attached directly to the vertical side wall 23 of the spa 21. In FIG. 6, what is known as a pedestal skirt attachment is illustrated in which the pivot block 27 is attached to the underside of an overhang extending along the under edge of spa 21.

Figure 4:
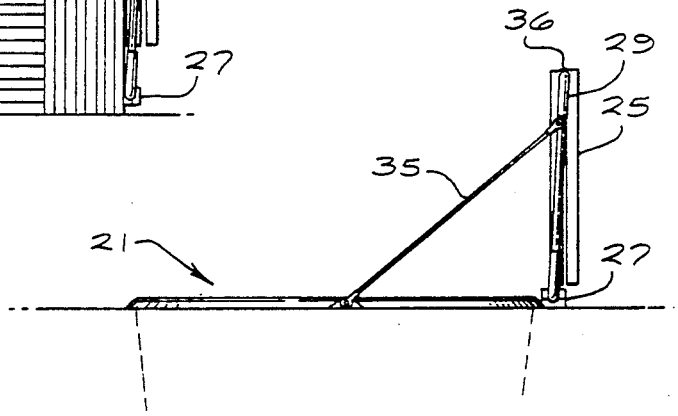
FIG. 4 illustrates the operation of the cover lift assembly on a ground level spa in the uncovered position.

In FIG. 7, in what is known as a flush skirt attachment, pivot block 27 is attached to a bracket 41 which is provided specially for the purpose of anchoring pivot blocks 27. These are but a few of the many methods in which the pivot blocks 27 may be affixed to provide pivotal support to the pivoting supports 33 and the bridge arm 32. In FIG. 4, the pivot blocks were attached to the grade level surface, or surface mounting.

In another embodiment of the cover lift cover lift assembly structure of the present invention, part of the force necessary to lift the cover 25 is supplied using the weight of the user. Referring to FIG. 8, the spa 21 is similar to that shown in FIGS. 1–3. FIG. 8 is virtually identical to FIG. 1–3 with the exception that FIG. 8 does not contain the retaining chain 35, but the corner bar 29 contains an additional feature. A kick stand 43 consists of an acutely angled bar whose ends are attached to corner bar 29. One end of the kick stand 43 is attached to the corner of corner bar 29 while the other end of kick stand 43 is attached near the end of corner bar 29 which is attached to pivoting support 33. Generally, at least end of kick stand 43 will be locate near the axis of pivot while the other end of kick stand 43 will be attached along the axis formed by pivoting support 33. Actually, although it cannot be ascertained with respect to FIG. 8, two kick stands 43, one on either side of spa 21, are most desireable. This is to facilitate the removal of the spa cover from either side of spa 21, as well as to provide balanced support.

In FIG. 8, the spa 21 is shown from the side. Again, as was the case described earlier, the bridge arm 32 extends adjacent the fold axis (not visible in FIG. 8) of cover 25. To remove the cover 25, the operator can, as was the case in FIGS. 1–3, grasp the pivoting support 33 and pivotally move it in a direction upwardly and away from spa 21. The user, however, may place his foot atop kick stand 43 to employ body weight to further assist in raising cover 25 from the spa 21.

Figure 9:
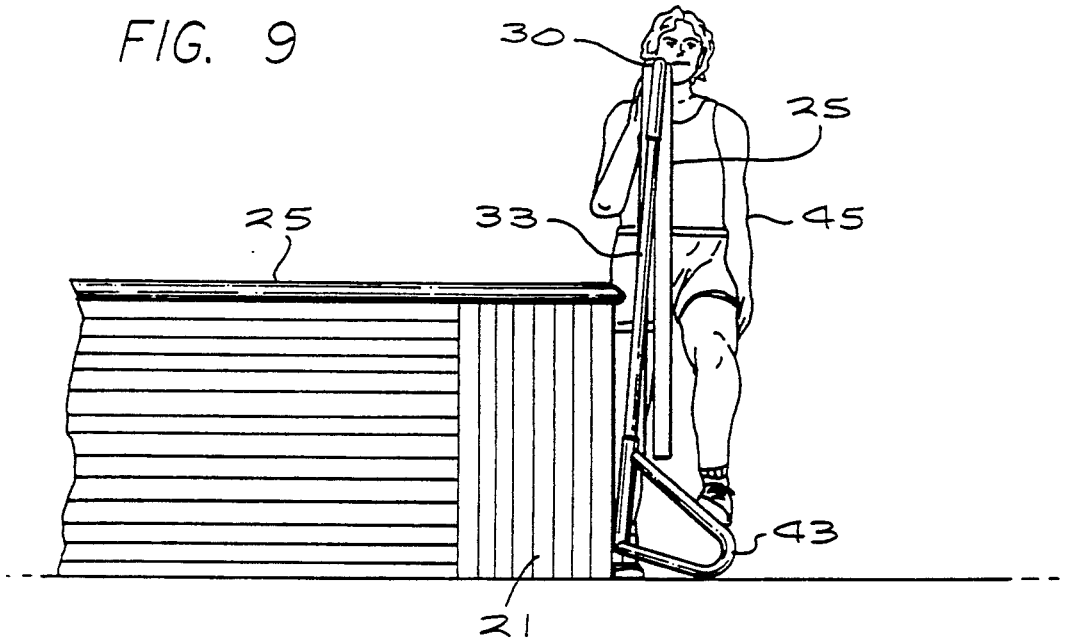
FIG. 9 illustrates the operation of the kick stand equipped cover lift illustrated in FIG. 8.

Referring to FIG. 9, a user 45 is illustrated having just moved the pivoting structure of the present invention into the uncovered and cover storage position. Note the position of the foot of user 45 atop the kick stand 43 along with manual lifting of one of the pivoting supports 33. Here, the user 45 has used both lifting and his body weight to lift the cover 25.

Referring still to FIG. 9, the folded, removed cover 25 is shown in place with the pivoting support 33 shown slightly angled to the right, as was the case in FIGS. 3 and 4. However, note that the kickstand 43 is now resting against the ground or other suitable surface to limit the further pivoting of the cover 25 away from the spa 21. Hence, the kickstand 43 acts both as a facilitator of lifting and a limiter of pivoting travel. In the second instance, it replaces the retaining chain 35.

Figure 10:
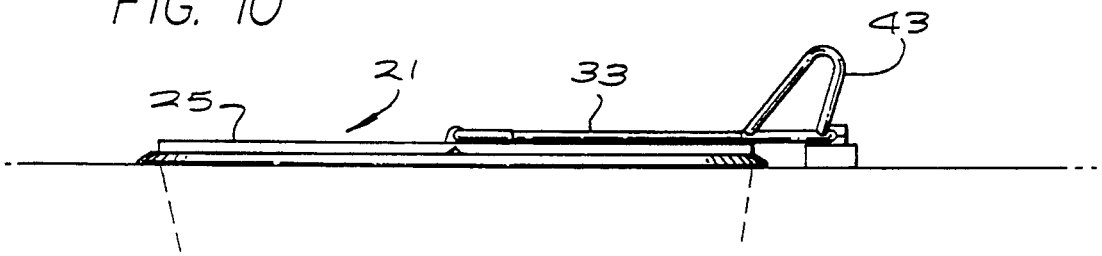
FIG. 10 illustrates the kick stand equipped cover lift shown in FIGS. 9 and 10 employed in conjunction with a ground level spa; and, FIG. 11 illustrates the use of the kick stand equipped cover lift in a spa having a non-rectangular shape.

Referring to FIG. 10, the utilization of the kick stand 43 shown in FIGS. 8 and 9 is accomplished with respect to an in-ground spa 21. The greater initial upward angle of kick stand 43 does not enable a mechanical advantage as good as was available in the above ground spa 21 initially, but still provides some assistance, and more importantly eliminates the need for the retaining chain 35.

Note also, that for the ground level installation of FIG. 10 that the ground mounted pivot blocks 27 may be mounted farther away from the spa 21 to even farther remove the folded cover from the proximity of the spa 21. This may be an important feature where greater space around the periphery of spa 21 between spa 21 and pivot blocks 27 is required.

Figure 11:
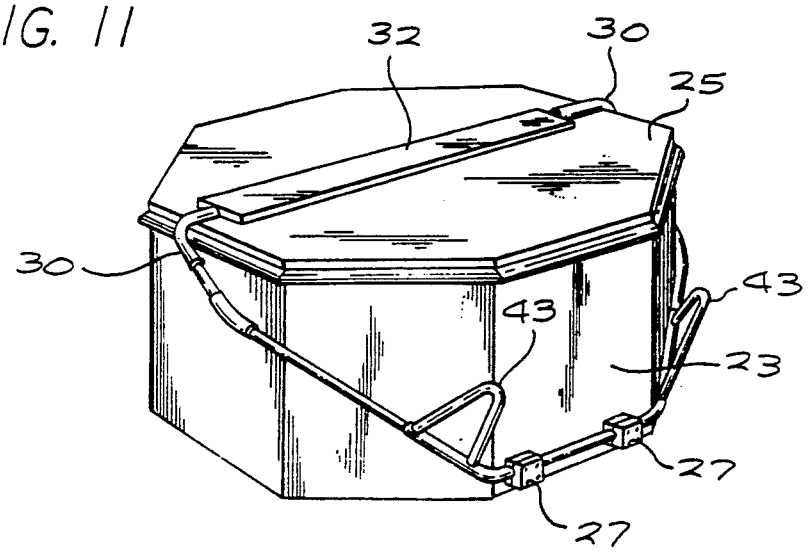

Referring to FIG. 11, a spa having a shape other than rectangular is illustrated. It is clear that the shape of the pivoting structure of the present invention may be altered to accommodate virtually any shaped spa 21. If the hexagonally shaped spa 21 of FIG. 11 were of the in-ground-type, the configuration of the pivoting structure of FIG. 10 could be utilized. Therefore, in-ground spas 21 can use a standard design of pivoting structure, generally irrespective of the shape of the spas 21.

The forgoing disclosure and description of the invention are illustrative and explanatory thereof, and various changes in the dimensioning, sizes, geometry of the component parts, materials of construction and method for joining the component parts, as in the details of the illustrated construction may be made without departing from the spirit and scope of the invention.

We claim:

1. A spa cover lift removal and support assembly for a hinged spa cover which covers the top of a spa and includes at least two cover sections connected by a hinge whereby said sections are foldable in overlapping relation comprising a pair of pivoting supports:

pivot means, adapted to be secured adjacent one side of a spa, and having a common pivot axis for facilitating pivoting said pair of about said common pivoting supports axis;

each pivoting support having a first end pivotally attached to said pivot means to pivot about said common axis, and each having a second end;

an upper bridge arm connected to said second ends of said pair of pivoting supports, said upper bridge arm pivotable to a first position adjacent and parallel to said hinge of said spa cover when covering said spa and to a second position clear of said spa whereby said cover sections are folded over said upper bridge arm and said upper bridge arm is pivoted to said second position to remove said cover from said spa and support said cover to one side of said spa.

2. The assembly of claim 1 further comprising a retaining chain having a first end attached to one of said pivoting supports nearer its second end, and a second end attachable to a spa.

3. The assembly of claim 1 wherein said pivot means further comprises a pair of pivot blocks; and, a pair of lower corner bars, each said corner bar connected to one of said pair of pivot blocks.

4. The assembly of claim 3 wherein said pair of pivot blocks are of two piece, halved construction.

5. The assembly of claim 3 wherein said pair of pivot blocks are attached to the vertical wall of said spa.

6. The assembly of claim 3 further comprising a spa and wherein said spa further comprises a pedestal skirt and wherein said pair of pivot blocks are attached to the underside of an overhang of said pedestal skirt.

7. The assembly of claim 3 further comprising a lower bridge arm between said lower corner bars for added stability.

8. The assembly of claim 3 wherein said spa is a ground level spa and said pivot blocks are attached to the ground.

9. The assembly of claim 3 further comprising at least one kick stand attached to one of said pivoting supports near said first end of one of said pivoting supports to facilitate the pivoting of said pivoting support.

10. The assembly of claim 3 further comprising a spa; and, a spa cover tiltable over said spa and having a hinge axis parallel to the axis of said upper bridge arm.

11. The assembly of claim 10 further comprising a retaining chain having a first end attached to one of said pivoting supports nearer its second end, and a second end attachable to a spa.

12. The assembly of claim 11 wherein said retaining chain is of sufficient length to limit the pivoting movement of said pivoting supports away from said spa just beyond a vertical position.

13. The assembly of claim 11 further comprising at least one kick stand attached to one of said pivoting supports near said first end of one of said pivoting supports to facilitate the pivoting of said pivoting support.

14. The assembly of claim 13 wherein said kick stand is positioned sufficient to limit the pivoting movement of said pivoting supports away from said spa just beyond a vertical position.

15. The assembly of claim 1 further comprising a pair of upper corner bars, each said corner bar connected between a second end of one of said pivoting supports and said upper bridge arm.

* * * * *

UNITED STATES PATENT AND TRADEMARK OFFICE

CERTIFICATE OF CORRECTION

PATENT NO. : 5,131,102

DATED : July 21, 1992

INVENTOR(S) : Philip J. Salley et al

It is certified that error appears in the above-identified patent and that said Letters Patent is hereby corrected as shown below:

On the title page, under "Inventors", "Quellette" should be --Ouellette--.

On the title page, under "Assignee", "Inc," should be --Inc.--.

On the title page, under "U.S. Patent Documents", reference: Scardenzan, "4,135,159" should be --4,135,259--.

On the title page, under "U.S. Patent Documents", reference: Nelson, "10/1986" should be --6/1986--.

On the title page, under "U.S. Patent Documents", reference: Adams, "1,106,228" should be --1,106,022--.

Abstract, line 9, "clearly" should be --cleanly--.

Column 3, line 43, ";" should be --,--.

Column 5, line 64, Claim 1, begin new paragraph with "a pair...".

UNITED STATES PATENT AND TRADEMARK OFFICE

CERTIFICATE OF CORRECTION

PATENT NO. : 5,131,102

DATED : July 21, 1992

INVENTOR(S) : Philip J. Salley et al

It is certified that error appears in the above-identified patent and that said Letters Patent is hereby corrected as shown below:

Column 5, line 64, Claim 1, after "comprising" insert --:--.

Column 6, line 1, Claim 1, after "of" insert --pivoting supports--.

Column 6, line 2, Claim 1, delete "pivoting supports".

Signed and Sealed this

Fifth Day of October, 1993

Bruce Lehman

*Attest:*

BRUCE LEHMAN

*Attesting Officer*

*Commissioner of Patents and Trademarks*